United States Patent [19]

Jensen et al.

[11] Patent Number: 4,518,318

[45] Date of Patent: May 21, 1985

[54] PUMPING SETS

[75] Inventors: Niels D. Jensen; Kurt F. Nielsen, both of Bjerringbro; Bent Larden, Rødkaersbro, all of Denmark

[73] Assignee: Grundfos A/S, Bjerringbro, Denmark

[21] Appl. No.: 511,794

[22] Filed: Jul. 7, 1983

[51] Int. Cl.[3] ..... F04B 49/06

[52] U.S. Cl. ..... 417/53

[58] Field of Search ..... 417/45, 53, 44, 63; 318/306, 332

[56] References Cited

U.S. PATENT DOCUMENTS

| | | | |
|---|---|---|---|
| 3,953,777 | 4/1976 | McKee | 417/45 X |
| 4,145,161 | 3/1979 | Skinner | 417/53 X |
| 4,225,289 | 9/1980 | Burkett | 417/53 X |
| 4,370,098 | 1/1983 | McClain et al. | 417/45 X |

OTHER PUBLICATIONS

IKZ, Heft 6 1980, pp. 44–51.

IKZ, Heft 15 1979, pp. 42–53.

*Primary Examiner*—Edward K. Look

*Attorney, Agent, or Firm*—Balogh, Osann, Kramer, Dvorak, Genova & Traub

[57] ABSTRACT

In the case of a pumping set comprising an electric motor and a rotary pump driven by the same, the r.p.m. may be controlled as a function of selected operating parameters of the set in steps within the area of a characteristic field, the limits of which are determined on the one hand by the two modulating graphs for the maximum and minimum r.p.m. figures and on the other hand by the co-ordinates delivery head and delivery flow. A particular partial span may in each case be determined on the modulating graphs valid for constant r.p.m. figures. An r.p.m. switching action is triggered upon reaching the operating parameters of the set representative for the terminal values of the partial spans, the r.p.m. being lowered if the one terminal value is reached on one partial span with the greater delivery head and the lesser delivery flow, and raised if the other terminal value on the partial span in question is obtained with the lesser delivery head and the greater delivery flow.

3 Claims, 2 Drawing Figures

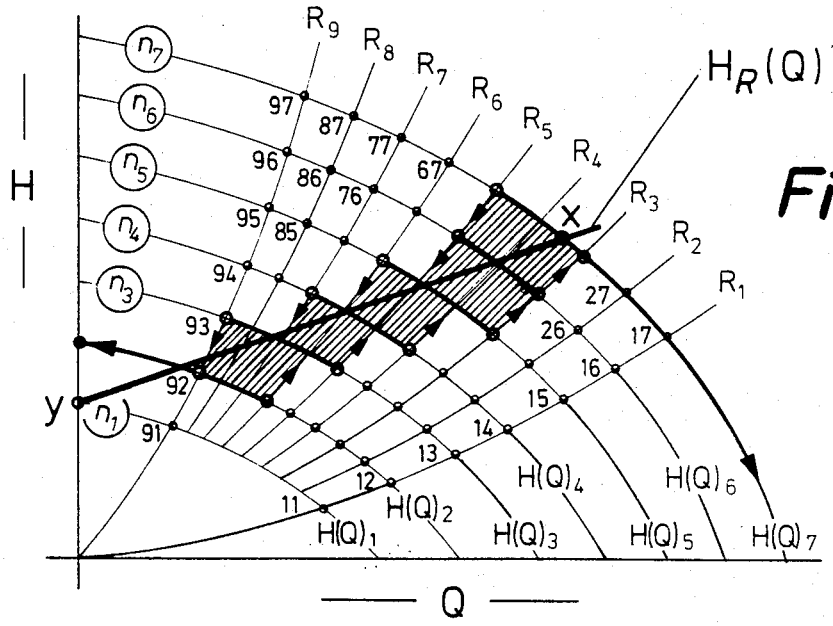
Fig. 1
Fig. 2
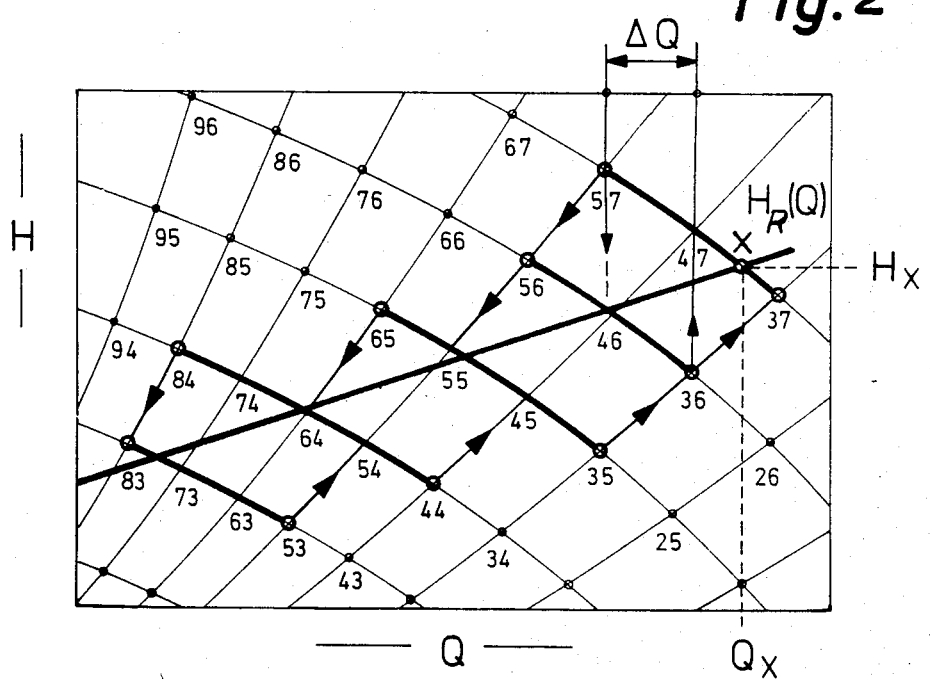

PUMPING SETS

BACKGROUND OF THE INVENTION

The present invention relates to a pumping set controlled by its rotary speed i.e. r.p.m., comprising an electric motor and a rotary pump driven thereby the rotary speed n of which may be regulated as a function of selected operating parameters of the set, in steps within the ambit of a characteristic range, the limits of which are determined on the one hand by the two modulation graphs H(Q) for the maximum and minimum r.p.m. figures and on the other hand by the co-ordination between delivery head H and delivery flow Q.

The point of operation of a pumping set as known coincides with the point of intersection of the plant characteristic $H_A(Q)$ and the modulation graph of the pump H(Q). Changes of this point of operation consequently render it necessary to vary the plant characteristic, the pump characteristic or both.

Varying the plant characteristic by restriction of a fitting or by opening of a by-pass, leads to power losses, as known. By contrast, the adaptation of the pump characteristic to the required operating condition of the set by r.p.m. variation, can be performed practically without loss. Apart from the lesser expenditure of power in such case, it is advantageous in many cases moreover for the r.p.m.-controlled pump to supply no more than the pressure difference required by the plant, so that flow noises may be averted. The plant outfitter thus requires a pumping set whose modulation graph may largely be adapted with satisfactory efficiency to the different plant characteristics and which may moreover be installed in as simple a manner as possible.

The requirement for pumps whose characteristics may be plotted at will has consequently already been put forward and discussed, the aim being to operate the pump outside the characteristic span range as far as possible, since flow noises in the water-carrying system and a poor control action could otherwise be expected.

Pumps developed under consideration of this principle, and the a.c. squirrel-cage motor of which may be operated under stepless control of r.p.m. by means of a frequency transofrmer, are available on the market. The pressure differential generated by the pump and measured, and the volumetric flow also measured, are compared in this case to a preprogrammed set graph and adjusted to this graph by acting on the r.p.m. Pumping sets controlled in this manner are very costly however, because of the involvement of mensuration techniques. Their control system is complex moreover and very vulnerable because of the considerable plant complexity. These sets are consequently limited to considerably powers as a rule and have to be installed by trained personnel.

It is an object of the invention to provide an inexpensive and uncomplicated r.p.m.-controlled pumping set, the plant graph of which may be in principle be optionally selected. This graph should be obtainable during operation of the set by stepped r.p.m. switching in optimum degree, without required complex mensuration techniques.

SUMMARY OF THE INVENTION

To resolve this problem, the pumping set in accordance with the invention, is such that a particular partial span may be plotted in each case on the modulation graphs H(Q) applicable for the r.p.m. figures $n_i$=constant, and that an r.p.m. switching action is triggered upon reaching electrical operating parameters of the set which are representative for the terminal values of the partial spans, by lowering the r.p.m. if the one terminal value is reached on one partial span with the greater delivery head H and the lesser delivery flow Q, and by raising the same if the other terminal value on the corresponding partial span is reached with the lesser delivery head H and the greater delivery flow Q. An imaginary control graph $H_R(Q)$ optionally preselected for each momentary practical case of application of the set may be plotted through the partial spans, so that the r.p.m. switching action is triggered upon reaching the electrical operating parameters representative for the terminal values of the partial spans, by lowering the r.p.m. if a terminal value is reached within the characteristic range which lies above the plant graph, and raising the same if a terminal value is reached which lies below the plant or set graph.

The predetermined control graph $H_R(Q)$ thus intersects a series of modulation graphs, each of these points of intersections being delimited by the terminal values of the corresponding partial span of the modulating graphs so that the electrical operating parameters decisive for the terminal values may then be co-opted for switching the r.p.m. and the preselected plant graph may be approximated by stringing together the partial spans of modulation graphs of different r.p.m. figures.

BRIEF DESCRIPTION OF THE DRAWINGS

In order that the invention may be more clearly understood, reference will now be made to the accompanying drawings which are operation curves illustrative thereof and in which:

FIG. 1 shows a series of modulation graphs, and

FIG. 2 illustrates an enlarged section of the characteristic field of FIG. 1.

DETAILED DESCRIPTION OF THE PREFERRED EMBODIMENTS

Referring now to the drawings, FIG. 1 shows a series of modulation graphs $H(Q)_i$ for constant r.p.m. figures $n_i$. With the plant unaltered, the relationships $Q_1/Q_2=n_1/n_2$, $H_1/H_2=n_1^2/n_2^2$ and $P_{Q1}/P_{Q2}=n_1^3/n_2^3$ are valid, these being referred to as affinity rules, Q being the delivery flow, H the delivery head, P the electric driving power and n the r.p.m. of the pumping set.

Since the abscissa varies lineraly in the H.Q graph, whereas the ordinate varies quadratically with the speed of revolution n, the co-ordinated points of the different modulation graphs lie on parabolas $R_l$ to $R_x$ which have their apex at the point of origin of the coordinates. All the points of intersection of such a parabola R with the modulation graphs H(Q) are characterised by similar speed triangles and identical surge conditions. They have an almost identical efficiency moreover, if the ratio between the maximum and minimum r.p.m. figures is not excessive. Quite particular numeric values k consequently result for all the points of intersection of a parabola with the modulation graphs, namely $Q/n=k_{Q1}$, $H/n_2$, or $P/N^3=kp$. The same also applies for the electrical data determined upon operation of the pumping set at the said points of intersection, say for the current rating or wattage of the driving motor, the voltage across the motor capacitor, the voltage applied to the windings, and the like.

As already stated, the parabola $R_1$ to $R_x$ divide all the modulation graphs H(Q) into particular partial spans and allocate to the extremities of the partial spans operating data representative for the parabola in question, so that the characteristic range or field is covered by a network of unequivocally defined points. Each of these points may be co-opted as a terminal point for a partial span which is to be selected, in such manner that the r.p.m. is lowered if the one terminal value is reached on one partial span with the greater delivery head H and the lesser delivery flow Q, and is raised if the other terminal value is reached on the corresponding partial span with the lesser delivery head H and the greater delivery flow Q.

If an imaginary control graph $H_R(Q)$ optionally preselected for the momentary case of application of the set is plotted through the partial spans, the operation described in the foregoing means—in other terms—that each terminal point of the grid situated to the left of or above the control graph may be utilised for lowering the r.p.m. and each terminal point situated below or to the right of the control graph for raising the same.

The manner in which these terminal or switching points should appropriately be selected, will be described in particular in the following. In any event, the data decisive or determinant for these points are stored as a control program, so that the control graph may be approximated in saw-tooth-like form by travelling the partial spans on the modulation graphs at different speeds of revolution.

The special advantage of this solution it is no longer the hydraulic data, such as pressure differential and delivery flow which can be measured by costly instruments only, which have to be detected and utilised for controlling the set, but that use may be made of the substantially more simply measurable electrical data such as current intensity and voltage across the operating capacitor, the motor winding and the like, which then in combination with or reference to the known or measured r.p.m. provide the switching signals.

It is relevant to observe moreover that the mesh width of the grid referred to in the foregoing, formed by the modulation graphs H(Q) and the parabola R, may be graduated in accordance with an arithmetical or geometrical progression. In the second case, the operation is conducted with a lesser number of r.p.m. stages and the control graph is always approximated with identical precentual precision.

Another advantage may be considered to consist in that the pumping set may be combined with the control system required into a component ready for installation which may be connected electrically and installed like any other and ungoverned pumping set, because all the control signals are picked up from the set and processed in the control unit present on the motor.

In the graph illustrated in FIG. 1, the modulation graph $H(Q)_1$ corresponds to the lowest r.p.m. $n_1$, whereas the modulation graph $H(Q)_7$ corrrsponds to the highest r.p.m. $n_7$. These two graphs delimit—with the delivery head H plotted as the ordinate and the delivery flow Q as the abscissa—the field in which the possible operating points of the pump may be situated. For practical reasons, that is for example if operation at satisfactory efficiency or a satisfactory suction performance of the pump is desirable, a limitation will be accepted however and particular affinity parabolas will be selected as limits on the contrary, and not the co-ordinate axes. These are the graphs $R_1$ and $R_9$ in FIG. 1.

To simplify the description, each point of intersection between an affinity parabola R and modulation graph H(Q) is denoted by the suffix numbers of the graphs. The number 97 for the point of intersection of the parabola $R_9$ with the modulation graph $H(Q)_7$, and the number 26 for the point of intersection of the parabola $R_2$ with the modulation graph $H(Q)_6$, are cited as examples. The field of application considered for the pumping set in question is consequently a quadrangle having the corners 97-17-11-91, in which connection it should be observed that the set may operate even as far as delivery flow zero on the modulation graph $H(Q)_2$, and as far as the delivery head zero on the modulation graph $H(Q)_7$, which is denoted by arrows departing from the points 17 and 92.

If the plant designer specifies a control characteristic $H_R(Q)$ which in the example illustrated in FIG. 1 is intended to be a straight line extending between the points x and y, this straight line then intersects particular partial spans on the modulation graphs H(Q), in such manner that selected terminal points of the partial spans are situated at either side of the plant characteristic, for example being points 37 and 57 for the speed of revolution $n_7$, terminal points 35 and 65 for the r.p.m. $n_5$, etc. During operation of the pump, it is possible to come close to the control graph $H_R(Q)$ by traversing partial spans of the modulation graphs valid for different speeds of revolution. In this connection, it is immaterial moreover whether the plant characteristic is selected as a lower or upper limit or else, as illustrated, as a mean value for the operation of the set, since this lies within the plant designer's discretion, in principle.

For a clearer grasp of a control example, let us consider the diagram shown in FIG. 2, which illustrates an enlarged section of the characteristic field of FIG. 1. The plant is planned, for example, for the delivery flow $Q_x$ and the delivery head $H_x$. Within the part-load range, the operating points should "follow" the control trace $H_R(Q)$ which was selected as a mean value in this case. It was assumed furthermore, that the plant in question was a hot water and central heating plant comprising thermostatic valves on the heating elements.

The operating point x calculated for maximum output lies on the modulation graph $H(Q)_7$ between the affinity parabolas $R_3$ and $R_4$. If several thermostatic valves then close, the pressure differential or the delivery head H increases, and the operating point x moves in the direction of the grid point 47.

A stability condition decides whether the r.p.m. $n_7$ may be lowered upon reaching the switching point 47. Hunting of the set between two speeds of revolution is then impossible, if the delivery flow $Q_i$ when turning the r.p.m. down from $n_i$ to $n_{i-1}$ is smaller than the delivery flow $Q_{i-1}$ when turning the r.p.m. up from the r.p.m. $n_{i-1}$ to $n_i$.

FIG. 2 shows that the delivery flow at point 47 is equal to that at point 36, which is scheduled as an upward switching point. To fulfil the aforesaid condition $Q_i < Q_{i-1}$, the next higher grid point 57 is selected as an r.p.m. switching point. Since $Q_i < Q_{i-1}$, $Q_{57} < Q_{36}$, and hunting of the control action is prevented. The next meshes of the grid may be considered in corresponding manner. The points 57-56-65-84-83 should be selected as appropriate upper limits for lowering the r.p.m. and the points 53-44-35-36 as points for upward switching of the r.p.m.

It will be grasped that the deviations of the actual operating points from the desirable values lying on the graph $H_R(Q)$ become the smaller the smaller the meshes of the grid, that is to say the closer the points selected for the switching actions lie to the imaginary control graph. No great precision is required however in many plants, so that few r.p.m. values and affinity parabolas would suffice. This is so, for example in the case of hot water central heating plants. In their case, a coarse approximation is adequate, because the same thermal efficiency can be established in one and the same plant with a greater water flow and lesser temperature differential between the outward and return flow of the heating water, or inversely. In this case, it is merely of importance that the pressure differential provided by the pump is so great that an adequate water distribution is assured within the system and that no values leading to flow noises in the fittings can be reached in any operating condition.

The manner in which the individual points may be discovered and set up as limits for the possible partial spans will be described in the following. The modulation graphs H(Q) for particular r.p.m. values $n_i$—constant as customary recorded on the test bench for a particular pump type. All the electrical data which should be utilised later for r.p.m. switching are also measured apart from the delivery head H and the delivery flow Q. For example, these data are the current absorbed by the motor, the voltage across the motor capacitor or else other values varying with r.p.m.

If the affinity parabolas which are to be preset optionally, are entered in the same diagram as the modulation graphs, particular electrical data may also be allocated to each point of intersection between a modulation graph and an affinity parabola, apart from the values H and Q.

The points of intersection result in a field of points and are allocated particular order numbers, for example those specified in FIG. 1. The electrical data appertaining to the points form the basis for all possible control programs and are stored. In this connection, the order for turning the r.p.m. up or down may be allocated at will to any point.

Furthermore, two possibilities will substantially be available for application of practical exploitation of the solution in accordance with the invention. In the one alternative, particular partial spans are fixedly preprogrammed on the modulation graphs by the makers, being those typical or and appropriate for frequently recurring cases of application of the pumping set in question. A partial span series will consequently serve as a model, in which no flow noises are to be expected in the operational field selected, whilst nevertheless assuring an uniform water distribution in the heating system. The set will thereby acquire a "negative characteristic" which corresponds say to the control graph $H_R(Q)$ shown in the illustrations or to the span XY.

The gradient and position of several usable graphs xy may be preset in different manner with the corresponding partial spans for a pump of one type, so that a single pumping set in principle provides a manufacturing series of pumps of different characteristics. The constructor of the heating system should then select the characteristic appropriate for his requirements from the characteristics in question.

Another possibility consists in leaving the choice of the partial spans to the actual constructor of the heating system. To this end, the individual point within the characteristic field should then however be selectible by means of a keyboard, a distinction still having to be drawn under consideration of the said stability condition, between the selected terminal points of the partial spans in question, at which the r.p.m. should be lowered or raised.

We claim:

1. A method of determining operational parameters in a pumping set the rotary speed of which is controlled, said pumping set comprising an electric motor and a rotary pump driven by the same, the speed of revolution n of which is regulated as a function of selected operating parameters of the set, in steps within the ambit of a characteristic range, the limits of which are determined on the one hand by two modulation graphs H(Q) for the maximum and minimum r.p.m. figures and on the other hand by the co-ordinates delivery head and delivery flow, a particular partial path being settable on each of the modulation graphs H(Q) applicable for the constant r.p.m. figures $n_i$ in order to initiate an r.p.m. switching action upon reaching the electrical operating parameters of the set which are representative for the terminal values of the partial paths, by lowering the r.p.m. if the one terminal value is reached on one partial path with the greater delivery head and the lesser delivery flow Q, and increasing the same if the other terminal value is reached on this partial path with the lesser delivery head H and the greater delivery flow Q, the invention which consists in that the r.p.m. switching actions are controlled in dependency on the situation of an imaginary control characteristic optionally preselected for the particular case of application of the set and plotted through partial paths of the modulation graphs and that the r.p.m. switching action is initated upon reaching the electrical parameters representative for the terminal values of the partial paths, by lowering the

2. A method according to claim 1, wherein all the possible terminal points of the partial paths lie on affinity parabolas $R_1$ which subdivide the range of modulation graphs H(Q) into the partial paths.

3. A method according to claim 1, wherein the terminal points lying on the modulation graphs $H(Q)_i$ and which cause lowering of the r.p.m. are situated to the left of the terminal points of the modulation graph $H(Q)_{i-1}$ for the next lower r.p.m. in the characteristic range, so that the relationship $Q_i < Q_{i-1}$ always applies in which $Q_i$ is the delivery flow at a terminal point of one partial path whilst $Q_{i-1}$ is a delivery flow on the partial path of the next lower modulation graph.

* * * * *